United States Patent [19]

McGregor

[11] 4,038,922

[45] Aug. 2, 1977

[54] APPARATUS FOR FEEDING TAGS

[76] Inventor: Harold R. McGregor, 210 Nixon Ave. SW., Wadena, Minn. 56482

[21] Appl. No.: 638,757

[22] Filed: Dec. 8, 1975

[51] Int. Cl.[2] ..... B41F 13/24

[52] U.S. Cl. ..... 101/232; 271/129; 271/138

[58] Field of Search ..... 101/426, 43, 44, DIG. 3, 101/232, 316; 271/129, 138, 10, 268; 112/11; 221/210, 233, 224, 236, 238, 220

[56] References Cited

U.S. PATENT DOCUMENTS

| | | | |
|---|---|---|---|
| 1,584,773 | 5/1926 | Ingram | 271/138 X |
| 2,875,693 | 3/1959 | Jergrell | 271/268 X |
| 2,937,019 | 5/1960 | Rose | 271/138 X |
| 3,249,353 | 5/1966 | Parker | 271/129 X |
| 3,285,604 | 11/1966 | Parker | 271/138 X |
| 3,338,192 | 8/1967 | King | 112/11 |
| 3,544,100 | 12/1970 | Desai | 271/10 |
| 3,771,448 | 11/1973 | Thomson et al. | 101/44 X |
| 3,911,813 | 10/1975 | Schaeffer | 101/43 |

*Primary Examiner*—Edward M. Coven
*Attorney, Agent, or Firm*—Williamson, Bains & Moore

[57] ABSTRACT

A method and apparatus adapted for processing tags, cards, or the like are disclosed herein. The apparatus preferably comprises a magazine for storing a predetermined quantity of tags and an associated slotted gate, feed dispensing system for automatically moving tags out of the magazine. In one form of the invention a swinging arm for moving tags outputted from the feed gate to a desired external station is provided. The feed gate preferably comprises a slidable push plate which reciprocally, slidably moves within an elongated channel provided adjacent the magazine. Each time the push plate goes through a cycle a single tag (or group of tags) is outputted from the magazine through the feed gate dispensing apparatus to a position external of the tag feeder. In one form of the invention a printing device is associated with the feed gate for printing information on tags before delivery to the desired external station.

16 Claims, 11 Drawing Figures

APPARATUS FOR FEEDING TAGS

BACKGROUND OF THE INVENTION

This invention relates generally to tag handling apparatus. More particularly, the present invention relates to apparatus for delivering tags, labels or the like to a remote or external bag processing operation.

Grains, seeds, foodstuffs, feeds and other granular materials are commonly packaged in bags which are processed through automated filling and packaging apparatus. The last stage of the filling process involves the sewing shut of the bag, and usually a label indicating the contents of the bag is fastened to the bag during the sewing operation. Appropriate labels or tags may be supplied to the sewing apparatus manually, or a variety of prior art tag handling apparatus may be employed. Of course, each tag should bear the appropriate indicating indicia so that each bag is properly and accurately labeled. Because of the wide variety of products packaged by grain or feed companies, for example, a large quantity of different labels must normally be maintained. The latter problem is further amplified by the fact that products are of course sold in a wide variety of container sizes.

Prior art devices for delivering tags to a sewing station are illustrated in U.S. Pat. Nos. 3,805,716, issued to Cerioni, on Apr. 23, 1974; 3,338,192, issued to M. D. King on Aug. 29, 1967; 2,850,993, issued to G. A. Palm on Sept. 9, 1958; and 2,274,051, issued to H. C. Feltman, on Feb. 24, 1942. The latter devices typically employ a moveable mechanism employed with one or more suction cups to contact and move tags out of the feed magazine. This approach is employed by King and Cerioni. The Feltman Tag Dispenser stores cards in a magazine which is provided with a manually actuable plunger for selectively outputting individual cards.

As will be readily appreciated by those skilled in the art, the environment in which feed or grain handling apparatus is operated is often quite dirty. As dust and other airborne particles accummulates on critical moving parts the reliability of such apparatus will be decreased. This is particularly true where pneumatically accuated suction cups are employed for removing cards from the various types of feed magazines. Although reliability is somewhat enhanced when a manually actuable card discharge magazine is employed, the labor costs associated with such a system can be prohibitive.

SUMMARY OF THE INVENTION

The present invention comprises tag discharge apparatus which is adapted for use in conjunction with bag filling machinery or the like.

The apparatus preferably comprises a magazine for storing a predetermined quantity of cards, and an associated feed gate dispensing means for automatically and periodically moving a single card (or predetermined number of cards) out of the magazine means to a position outside of the apparatus. In one form of the invention swinging arm means are provided for moving cards to a desired remote location. The feed gate dispensing apparatus preferably comprises a reciprocally moveable, slidable push plate which engages a predetermined number of tags and slidably feeds them out through the feed gate. The moveable push plate is slidably suspended within an elongated channel defined between tag confining planar plates which adjoin the magazine means. In the preferred embodiment the reciprocal push plate and the swinging arm card moving means are both powered by conventional pneumatic cylinders. Sensing means are provided for actuating the pneumatic cylinders in response to movement of a bag to be sewed along a predetermined conveyor route.

In the preferred embodiment the feed gate dispensing apparatus includes an elongated tag retaining gate operatively mounted at the tag discharge side of the tag confining planar plates. A plurality of tag discharge slots, defined between the plate and the feed gate, provide a pathway through which the tags must travel in response to lateral movement of the push plate. Although a central discharge slot is substantially equal in width to the thickness of the predetermined number of tags passing therethrough, the width of upper and lower slots is substantially greater than the thickness of the central slot so that jamming of the apparatus when cards are bent or somewhat mutilated is prevented. The tag gate is provided with adjustable mounting means whereby the effective slot widths can be selectively varied to accommodate differing tag thicknesses (or numbers).

In one form of this invention printing apparatus is included for individually printing cards before delivery to the sewing station (or other external position). The printing apparatus comprises a conventional printing block and a backing plate normally associated with the tag dispensing apparatus. As cards (or predetermined bunches of cards) are individually discharged from the magazine relevant product information will be continuously printed on the cards before they are forwarded elsewhere. In this manner fewer cards need to be inventoried by the packer, who merely needs to reset the print type to indicate the appropriate identification data such as bag size, quality or type of contents, etc. relevant to the contents of the bag being filled.

A method provided herein for handling tags or labels comprises the steps of storing tags in a magazine, slidably discharging the tags from the magazine with a reciprocally operable push plate printing information on the tags, and delivering printed tags to a remote tag receptive operation. In one form of the invention a control method for initiating and synchronizing the above mentioned steps is provided.

Thus an object of this invention is to provide a tag dispensing apparatus which will function automatically with a high degree of reliability.

Moreover it is an important object of this invention to provide dispensing apparatus of the character described which will function adequately within a hostile environment. It is an important feature of this invention that the tag discharge apparatus characterized by a slidable push plate for engaging tags is unlikely to jam or be affected by dust or other airborne debris.

Another object of this invention is to provide a method and apparatus of the character described for automatically and periodically conveying a predetermined number of tags to a predetermined external position.

Yet another object of this invention is to provide a tag dispenser of the character described which will not jam or become blocked when cards are bent or are otherwise mutilated. An important feature of this invention is a tag retaining gate which is operatively mounted on the feed dispensing means, and which defines a plurality of tag passage slates along its length. Since the width of the upper and lower tag passage slates is substantially greater than the thickness of the card to be discharged, bends or folds within the card will not jam the apparatus.

A further object of this invention is to provide apparatus of the character described which is readily adaptable for use with existing bag sewing machines of the type often employed in feed or grain packaging businesses.

Still another object of this invention is to provide a tag feeding and dispensing machine of the character described which does not require manual manipulation by the operator.

Another important object of this invention is to provide a tag dispensing machine of the character described which will function whether oriented horizontally or vertically.

Yet another object of this invention is to reduce the quantity of tags or cards which must normally be inventoried by the operator, and to simplify the processing and labeling of the various products handled. An important feature of this invention is that printing means are provided for appropriately marking tags with suitable product identification indicia during the tag feeding operation.

A still further important object of this invention is to provide tag handling apparatus which will function with a high degree of safety in dusty environments. A feature of this invention is that no electrical or other potential spark generating apparatus is included. Instead pneumatic apparatus is preferably employed to actuate the various moving parts.

These and other objects of this invention, along with features or novelty appurtent thereto, will appear or become apparent in the course of the following description.

BRIEF DESCRIPTION OF THE DRAWINGS

In the following derawings which form a part of the specification and are to be construed in conjunction therewith, and in which like reference numerals have been employed to indicate like parts in the various views.

DETAILED DESCRIPTION OF THE DRAWINGS

Figure 1:
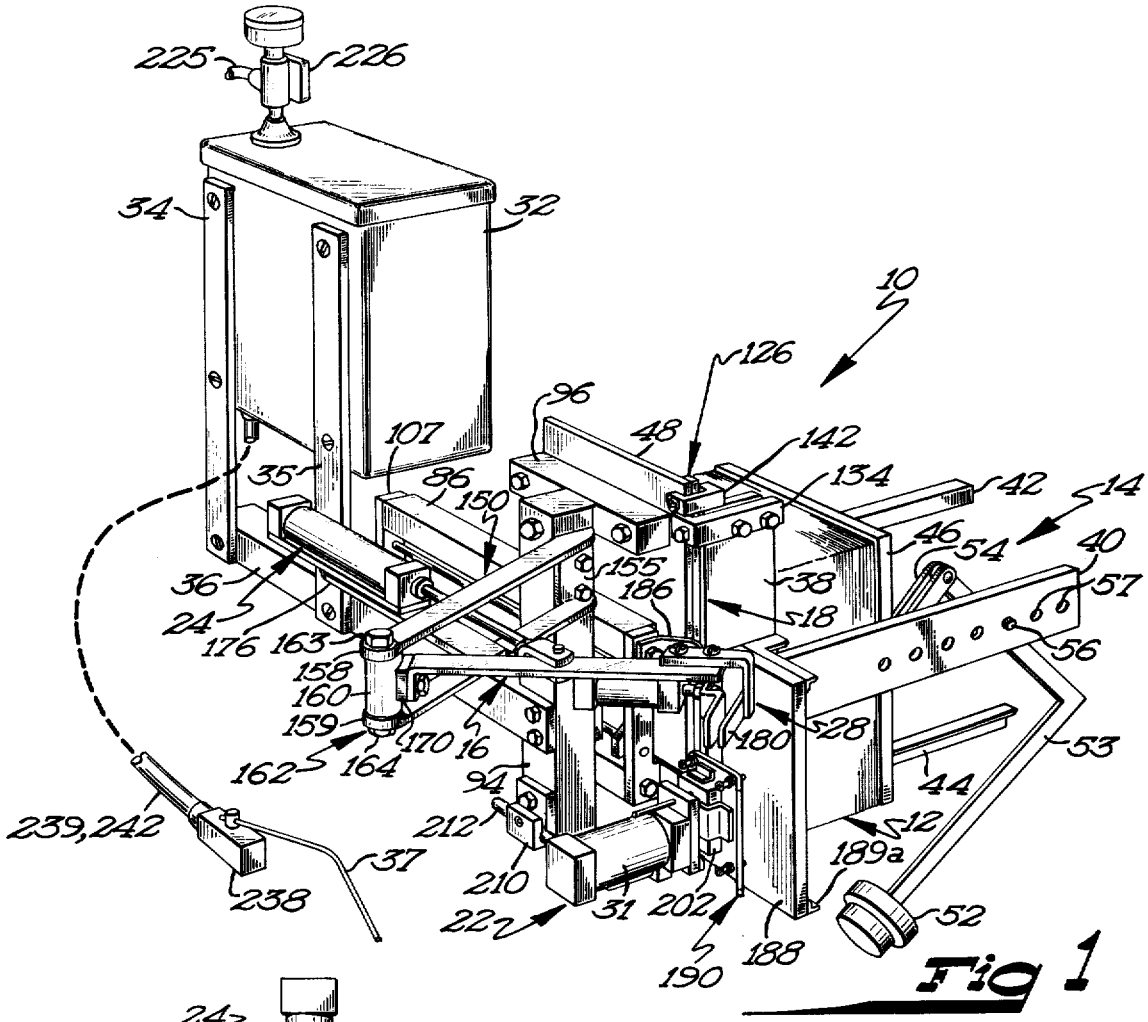
FIG. 1 is a perspective view of an automatic tag feeder constructed in accordance with the teachings of this invention.

Referring initially to FIG. 1, the apparatus 10 thereshown is adapted to repeatedly feed a predetermined number of tags, cards, or the like to an external operation station. For example, machine 10 is ideally suited to deliver paper tag labels to a bag sewing operation during the processing of feeds, grains, seeds or the like. One bag sewing machine with which the invention may be advantageously employed is the Fischbein Model MTC7 bag closer.

Figure 3:
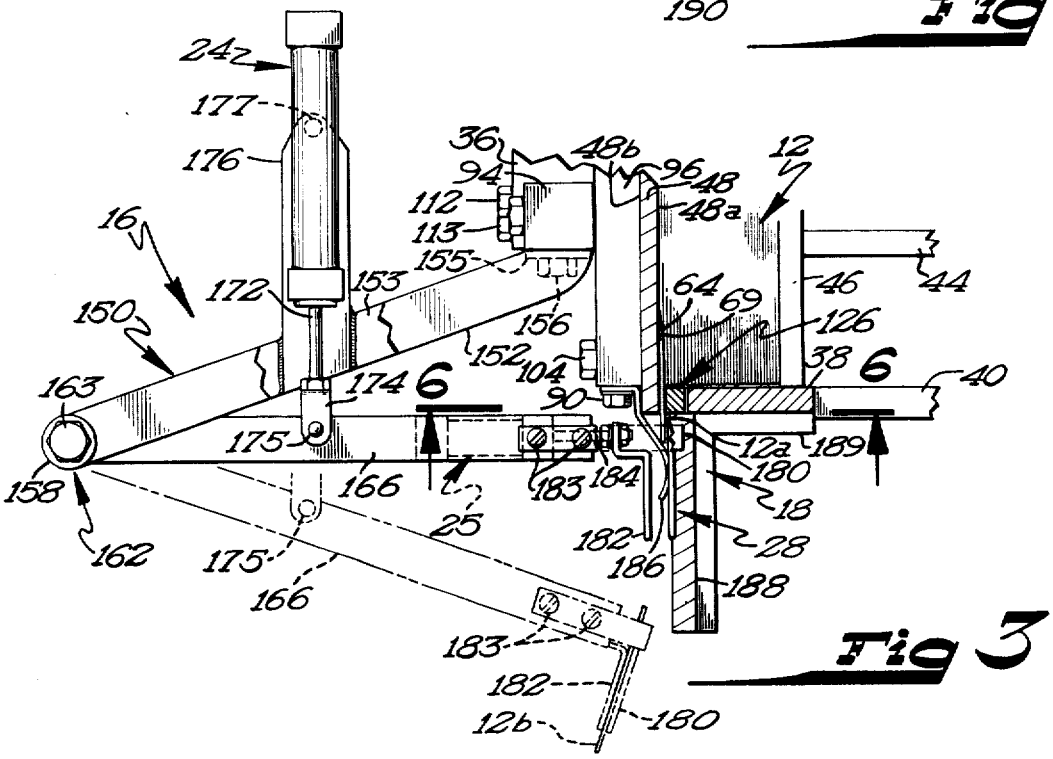
FIG. 3 is a top plan view taken generally along line 3—3 of FIG. 2, with parts thereof broken away or omitted for clarity.
Figure 2:
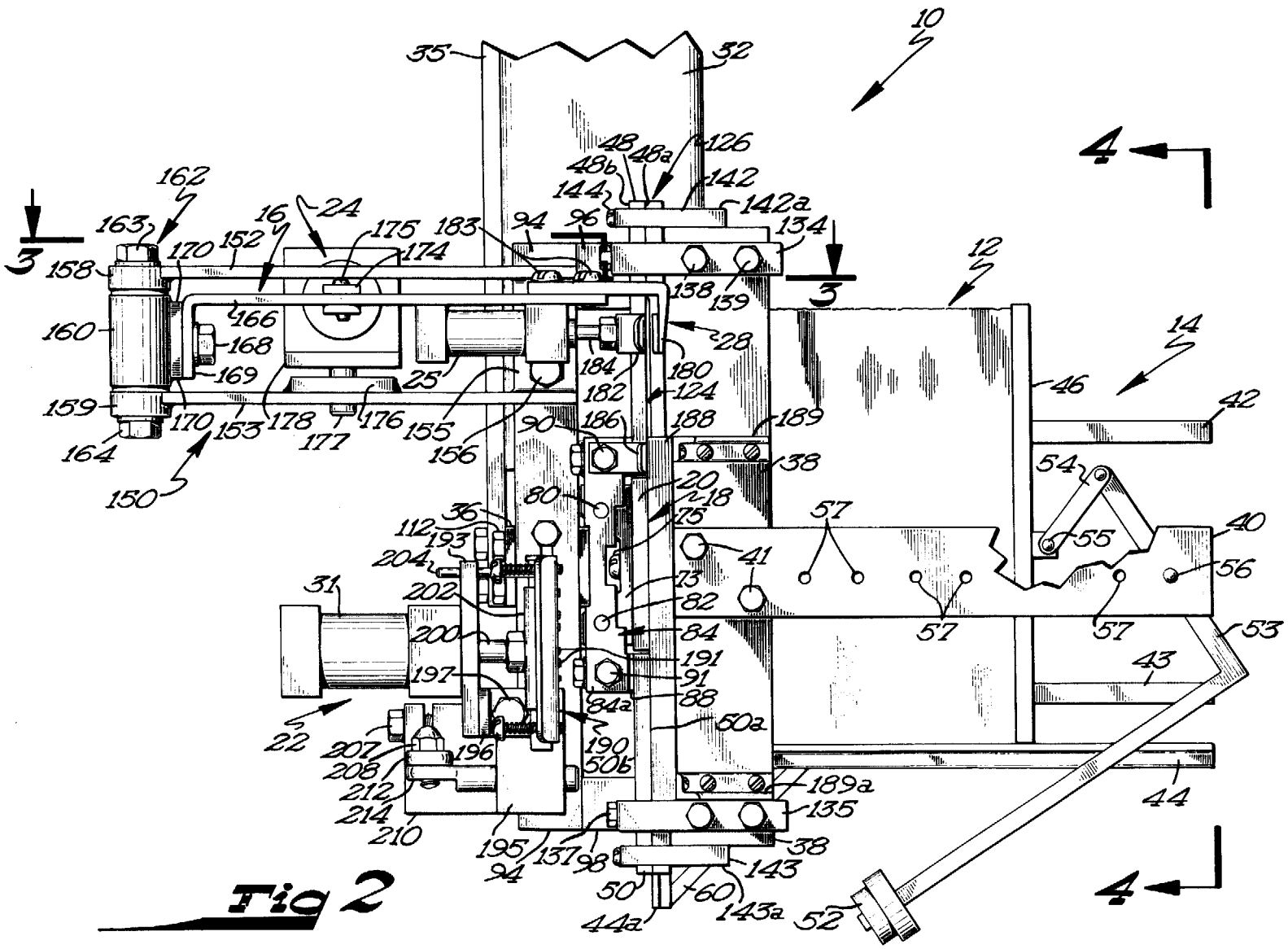
FIG. 2 is an enlarged, front elevational view of the apparatus of FIG. 1, showing the swing arm apparatus in the retracted position.

A plurality of stacked cards or tags 12 are stored within a magazine means 14 and are delivered externally of apparatus 10 by a swing arm assembly 16. Each of the cards or tags is first outputted through a feed gate dispensing means 18 via a slidable push plate 20 best seen in FIGS. 2 and 4. When cards (or groups of cards) are outputted through the discharge apparatus 18 printed information may be provided thereon by printing apparatus 22. A pneumatic cylinder 24 is preferably provided for actuation of swing arm apparatus 16 (FIGS. 2 and 3). Likewise a preferably pneumatic cylinder 25 mounted on swing arm means 16 actuates tag gripping apparatus 28. Pneumatic cylinders 30 and 31 are preferably provided to operate push plate 20 and printer 22 respectively. Each of the pneumatic cylinders is actuated by apparatus preferably housed within a control box 32, mounted on stanchions 34 and 35 (FIG. 1), which extend vertically upwardly from the lower elongated frame member 36. While operation of the pneumatic apparatus will be described in more detail later, passage of an item to be labeled by a tag triggers the apparatus by deflecting remotely located finger 37.

Magazine means 14 preferably includes a vertically oriented (as viewed in FIG. 2) rectangular side plate 38 which forms a card retaining surface. A preferably rectangular side plate 40 extends rightwardly from plate 38 (as viewed in FIG. 2) and is attached thereto via bolts 41. The opposite side of the magazine is formed by angle brackets 42 and 43, and the magazine bottom is formed by a lower angle bracket 44. Plate 40 and brackets 42–44 thus define a generally rectangular, card receptive volume. A rigid, generally rectangular pressure plate 46 is moveably mounted generally perpendicular to brackets 42–44 for biasing cards or tags 12 leftwardly (as viewed in FIG. 2). Plate 46 will thus maintain the cards or tags in abutment with upper and lower transverse, stationary frame plates 48 and 50 in proper operative relationship with the slide plate 20, which is responsible for sliding tags or cards out of the magazine.

A weight 52, which may be varied in mass as desired by the operator, is linked to plate 46 via a right angled linkage 53 and a cooperating, pivotally attached linkage 54 to urge plate 46 (and thus cards 12) leftwardly (as viewed in FIG. 2). Linkage 54 is attached to plate 46 via a pivot pin 55, and linkage 53 is pivotally mounted with respect to guide bar 40 through a pivot 56. As noted in FIGS. 1 and 2 a plurality of orifices 57 are provided in guide bar 40 for variable placement of pivot 56, to thereby provide adjustable bias of plate 46. As will be recognized by those skilled in the art plate 46 may alternatively be biased by springs, or hydraulic or pneumatic cylinders, or other conventional apparatus.

Figures 4, 5:
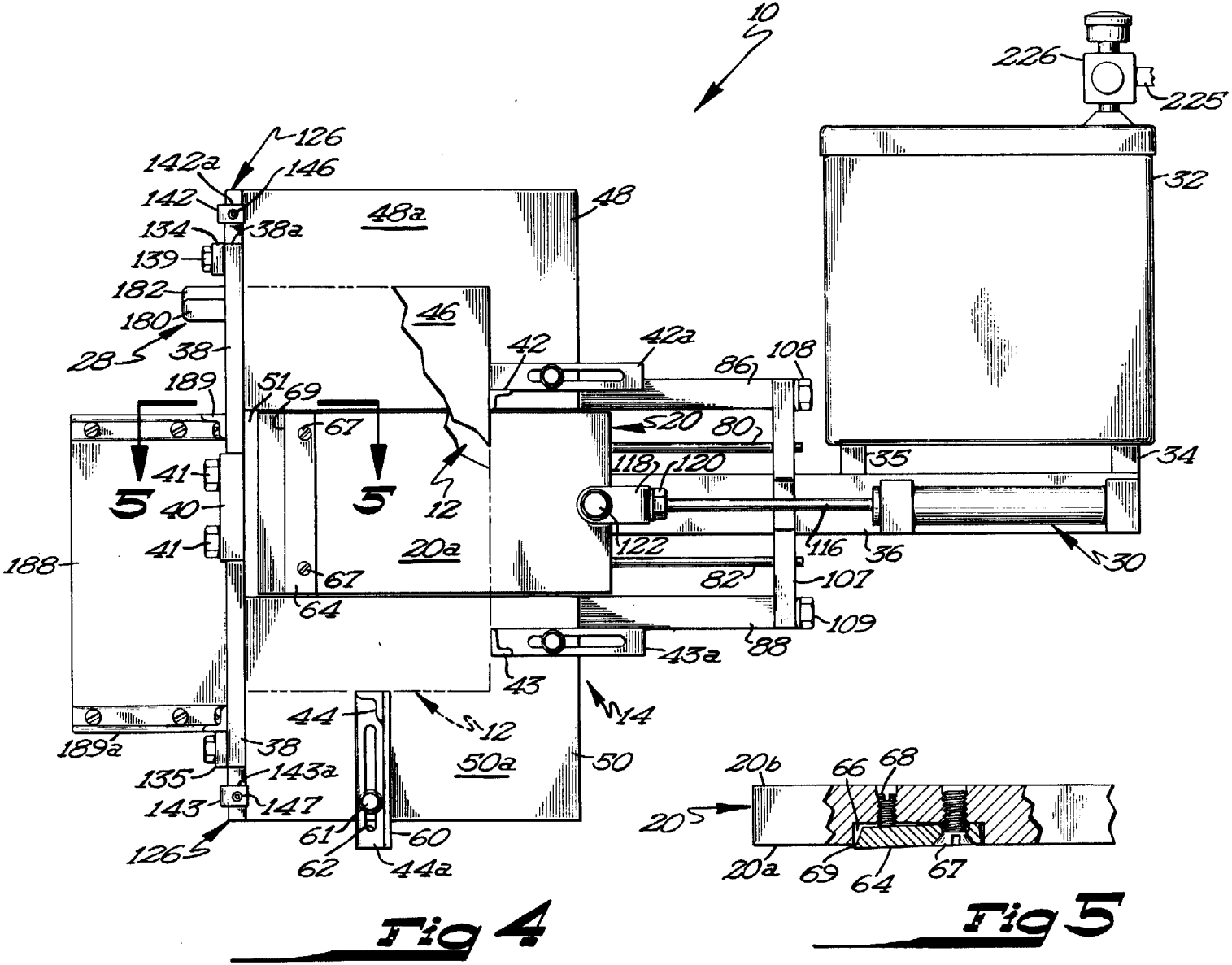
FIG. 4 is a side elevational view of the apparatus taken generally along line 4—4 of FIG. 2.
FIG. 5 is an enlarged, sectional view of the push plate showing the offset knife and taken generally along line 5—5 of FIG. 4, with parts thereof broken away or shown in section for clarity.

Lower magazine guide bar 44 is slidably, frictionally contacted by back plate 46 and the cards or tags 12. As best seen in FIG. 4, the vertical position of guide bar 44 may be varied to accommodate tags of different sizes or lengths. For example, guide bracket 44 is rigidly attached to a vertically oriented angle bracket 60 (FIG. 4) which is adjustably mounted to lower frame plate 50 by a bolt 61. Slotted appurture 62 provided in bracket 60 enables repositioning of bracket 44 by vertical movement of bracket 60 with respect to plate 50. Similarly, magazine side support bars 42 and 43 are adjustably mounted via horizontally positionable brackets **42*a* and 43*a* respectively (FIG. 4**).

The reciprocally slidably moveable push plate 20 (FIGS. 2, 4, 7) is adapted to selectively output single cards or tags (or a given number of cards or tags) from the feed gate dispensing means 18. Pressure plate 46 will bias the stack of cards 12 toward abutting engagement with the front surface (FIG. 4) of slide plate 20 and face surfaces **48*a* and 50*a* of plates 48 and 50 respectively. Slide plate 20 is preferably positioned within an elongated channel 51 defined between the vertically spaced apart plates 48 and 50. An offset knife 64 (FIGS. 3–5) is fastened within a slotted portion 66 provided in plate 20 by a pair of screws 67. As best seen in FIG. 5 a set scrw 68 is provided at an opposite face of plate 20 to variably offset knife 64 whereby the oblique leading edge thereof 69 will engage single or multiple cards. Thus, for example, screw 68 should normally be set such that leading edge 69 is offset from plate surface 28** a distance corresponding to the thickness of a card (or group of cards or tags) to be displaced thereby.

Figure 6:
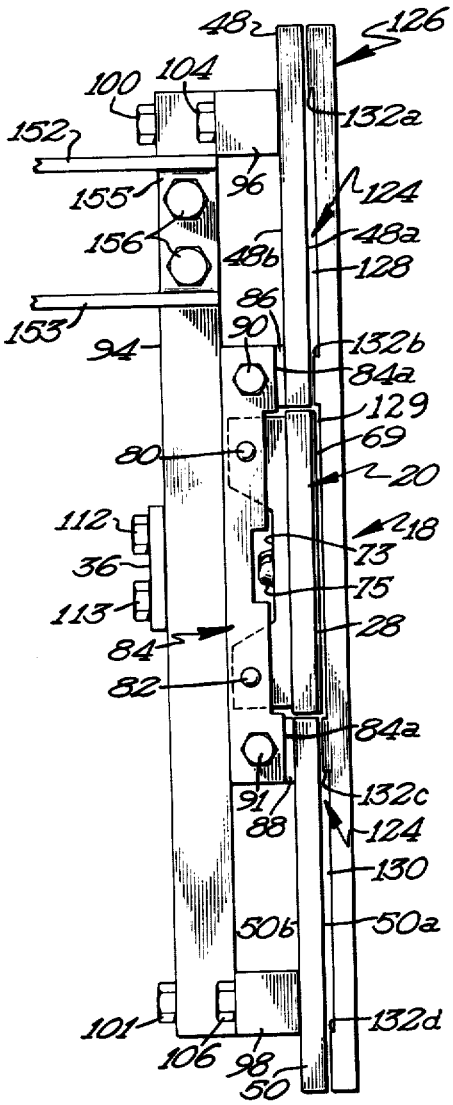
FIG. 6 is an enlarged sectional view of the feed gate taken generally along line 6—6 of FIG. 3, with parts thereof broken away, omitted, or shown in secton for clarity.
Figure 7:
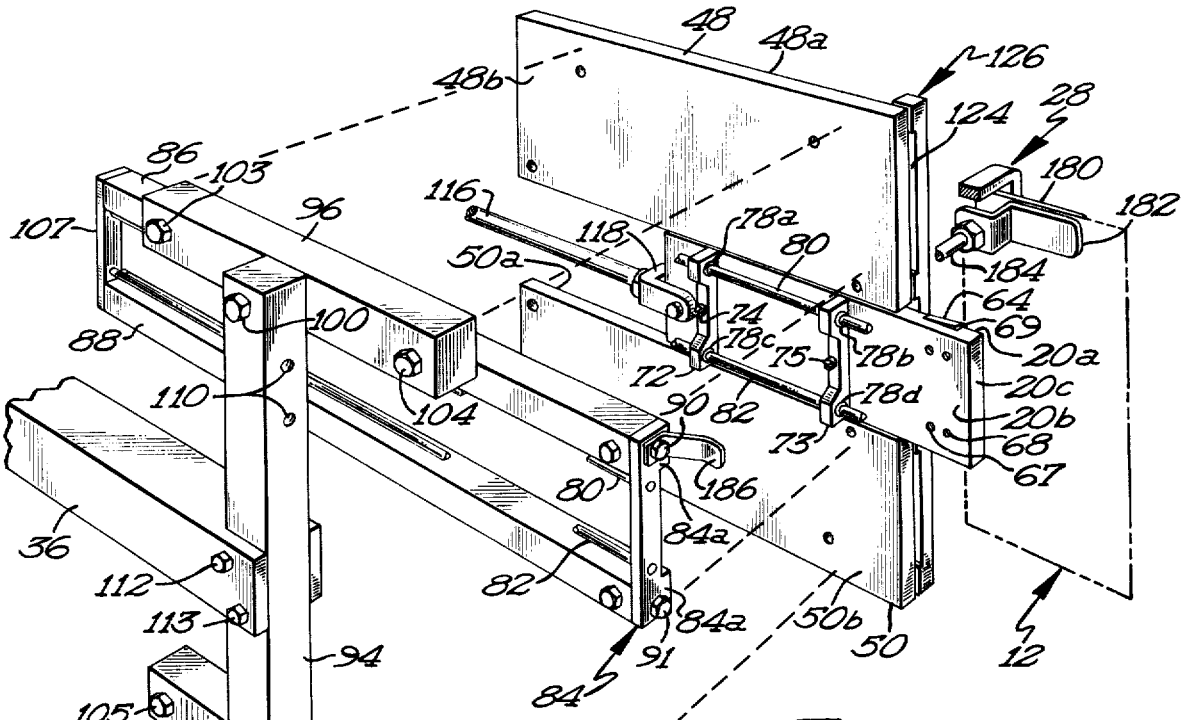
FIG. 7 is an exploded, enlarged perspective view showing the slide plate guide bar construction.

Plate 20 is preferably slidably suspended within channel 51 by the apparatus most clearly shown in FIG. 7. Plate 20 is provided with a pair of generally C shaped, apertured spaced apart bearing brackets 72 and 73 which are flushly mounted on surface **20*b* thereof by screws 74 and 75 respectfully. Aligned bearing apertures 78A and 78B located generally at the top of brackets 72 and 73 respectively slidably receive an upper guide rod 80 which extends generally longitudinally parallel in offset spaced apart relationship with plate 20. A similarly constructed lower guide bar 82 extends through bottom bearing apertures 78C and 78D. The forward ends (as viewed in FIG. 7) of the guide rods 80 and 82 are anchored within a generally rectangular, vertically oriented, slide rod support bracket 84. Bracket 84 is mounted to a pair of parallel, spaced apart, generally rectangular frame bars 86 and 88 via nuts 90 and 91 respectively. The rearwardly extending frame bars 86 and 88 are mounted to an upright vertically oriented frame stanchion member 94, which provides rigid support for a somewhat larger pair of upper and lower transverse frame bars 96 and 98. Bars 96 and 98 are of generally rectangular cross section, and are fastened to stanchion 94 via a pair of mounting bolts 100 and 101 respectively. Upper frame bar 96 is rigidly fastened to upper frame plate 48 (FIG. 6) by a pair of mounting bolts 103 and 104 which are located at opposite ends thereof, and lower frame bar 98 is similarly fastened to lower frame plate 50 by a pair of mounting bolts 105 and 106. The rearward ends (FIG. 4) of upper and lower frame bars 86 and 88 receive a rear slide rod support bracket 107, which is identical to bracket 84 and which rearwardly anchors slide rods 80 and 82. Bracket 107 is fastened to frame bars 86 and 88 by bolts 108 and 109 respectively, and it is rigidly fastened to frame member 36**.

In this manner the generally rectangular slide plate 20 is confined for movement within elongated channel 51 defined between the spaced apart frame plates 48 and 50. When plate 20 is moved forwardly (as viewed in FIG. 6) the front surface **20*c* thereof will be generally flush with the forward surface 84A of bracket 84. As will be discussed in more detail later, frame stanchion 94 includes a plurality of vertically spaced apart holes 110 for mounting of the swing arm apparatus 16. Elongated, generally rectangular, rearwardly extending frame member 36 is also fastened to stanchion 94 by a pair of mounting bolts 112 and 113**.

Actuation means 30, preferably comprising a conventional pneumatic cylinder, is mounted at the rearward end of frame portion 36 (FIG. 4) and is mechanically linked to plate 20 via a piston rod 116 which is attached to a clevis 118 via a bolt 120. Clevis 118 is pivotly attached to plate 20 via pivot 122. In response to pneumatic pressure rod 116 will be displaced leftwardly (as viewed in FIG. 4) thereby slidably moving plate 20 so that knife 64 thereof will engage a tag or card (or alternatively a predetermined number of tags or cards) and move them out of the dispensing apparatus, into a position to be picked up by swing arm assembly 16.

Referring again to FIG. 6, cards are discharged from the feed gate dispensing means 18 through an elongated tag passage slot 124 defined between plates 20, 48, 50 and a generally rectangular gate 126. In the preferred embodiment tag passage 124 actually comprises a plurality of tag passage slots 128 through 130. Gate 126 is provided with offset portions 132A through 132B which maintain gate 126 in generally parallel, spaced apart relationship with respect to plate 48 and 50. The upper and lower vertical boundaries of slot 128 are formed by portions 132A and 132B. Similarly, the upper and lower vertical dimensions of passage slot 130 are defined between offset portions 132C and 132D. It will be appreciated that the width of portions tag passage slots 128 and 130 is appreciably greater than the width of tag passage slot portion 129, which is immediately opposite the face 20A of card push plate 20. This construction enables plate 20 (via knife 64) to push a single card (or predetermined number of cards) through the tag passage slot 124, the narrow width of tag passage slot portion 129 facilitating this. However, the wider width of upper and lower tag passage slot portions 128 and 130 enables cards which have been somewhat bent or mutilated to be transmitted through the apparatus without jamming or blocking. Where cards of different widths are to be accommodated, or where it is desired to output two or more cards at a given time, the spacing of gate 126 with respect to plate 48 and 50 must be varied. Of course, as described earlier in conjunction with FIG. 5, the knife 64 must be correspondingly readjusted via screw 68.

Figure 8:
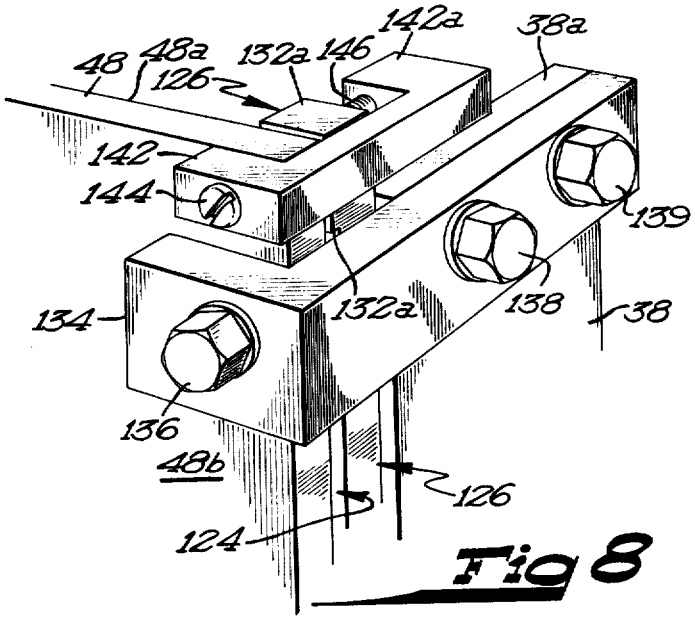
FIG. 8 is an enlarged, perspective view showing the tag discharge slot adjustment apparatus.

Gate 126 is selectively positioned in offset relationship with plates 48 and 50 with apparatus shown in FIGS. 2 and 8. Plate 48 is maintained in rigid, perpendicular spaced apart relationship with respect to plate 38 via a generally L-shaped mounting bracket 134 which is attached thereto via conventional bolts 136. Bolts 138 and 139 similarly fasten bracket 134 to plate 38. An L-shaped bracket 135 similarly fastens plate 50 to the bottom of plate 38 (FIG. 2). A generally C-shaped mounting clamp 142 of somewhat smaller cross-sectional area is rigidly attached to plate 48 via a screw 144, and an identical clamp 143 is similarly attached to plate 50. An opposite end 142A of clamp 142 overlies the upper end surface 38A of plate 38 and is spaced apart from lower bracket 134. The upper end of gate 126, and more particularly region 132A thereof is interiorly disposed between clamp portion 142A and plate 48, being maintained in correct positional alignment via a set screw 146. When it is desired to accommodate cards of differring widths, or different numbers or quantities of cards or tags, screw 146, for example, should be adjusted in cooperation with similar adjustment of lower clamp 143 and screw 147 to offset gate 126 the appropriate distance from plate 48. Of course knife 64 must similarly be adjusted as previously described.

The swing arm assembly 16 is operable to grab a card or tag outputted through tag passage slot 124, and to move the tag or card to an external position. Assembly 16 preferably comprises a stationary, rigid transom 150 which consists of a pair of parallel, vertically spaced apart elongated arms 152 and 153, of generally flat, rectangular cross section (FIGS. 2 and 3). As best seen in FIG. 1 the inner ends of arms 152 and 153 are integral with a mounting plate web 155 which is rigidly secured to stanchion 94 by a pair of bolts 156. The outer ends of arms 152 and 153 terminate in bearing aperture structures 158 and 159 respectively, between which an axially aligned, rotatable sleeve member 160 is sandwiched. An axle assembly 162 penetrates members 158, 159 and 160 to facilitate revolvable mounting of sleeve 160. Axle assembly 162 preferably comprises an elongated bolt 163 and a lower nut 164. A generally L-shaped, rigid swing arm 166 is rigidly fastened to sleeve 160 by a bolt 168 which extends through the lower foot portion 169 in arm 166 into threaded engagement with a rigid plate 170 which is preferably welded to sleeve 160.

The moveable swing arm 166 is pivotally deflected by a preferably pneumatic cylinder 24, the piston rod 172 thereof positioned between upper and lower arms 152 and 153 and being pivotally attached to swing arm 166 intermediate the ends thereof by a clevis 174 and pin 175. As best seen in FIGS. 2 and 3, the pneumatic cylinder 24 is pivotally mounted to a rearwardly extending mounting bar 176 by a pin 177 which extends downwardly from piston cylinder frame member 178 through an appropriate bearing aperture provided at the rear of member 176. Mounting member 176 is preferably rigidly attached to transit arm 153 through welding or the like (FIG. 3).

Tag gripping apparatus 28 is provided in association with swing arm 162 to grasp tags or cards (or bunches of tags or cards) outputted through the feed gate dispensing apparatus, already described. The swing arm tag gripping end 166A is provided with a gripping arm head 180, and a cooperating gripping clamp 182, which is preferably actuated by a pneumatic cylinder 25. As best seen in FIG. 2, gripping head 180 is of generally L-shaped construction and is fastened rigidly to swing arm 166 by a pair of bolts 183. Gripping clamp 182 is operatively associated with cylinder 25 via piston rod 184 which extends therebetween. As cards or tags are outputted through the tag passage slot 124 they will be positioned immediately between tap gripping clamp 182 and the lower portion of arm head 180, so that they will be compressively sandwiched between members 180 and 182 when cylinder 25 is actuated. Before actuation of cylinder 25, however, cards outputted from the feed dispensing means will be prevented from dropping by a curved spring member 186 (FIGS. 2 and 3) which yieldably biases outputted tags or cards against a printing backplate 188 to be later described. Spring 186 is preferably securely mounted by a bolt 90 discussed earlier in conjunction with FIG. 7. After a tag 12B (FIG. 3) has been securely grasped by the apparatus 28 it will be moved to an external position, such as the deflected position illustrated generally in dotted lines in FIG. 3.

Figure 9:
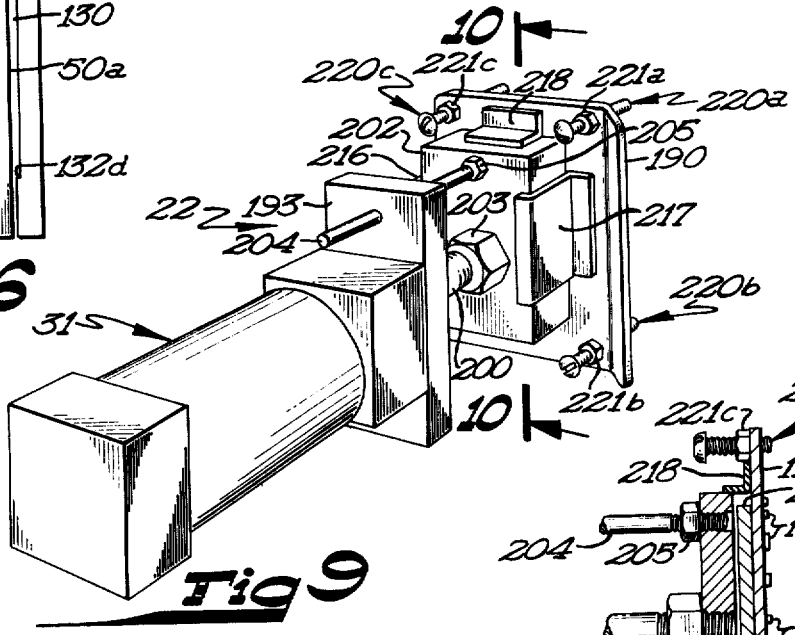
FIG. 9 is an enlarged, perspective view of the tag printer apparatus.
Figure 10:
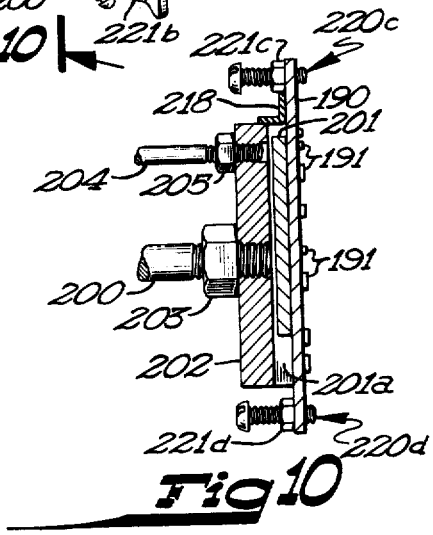
FIG. 10 is a sectional view of a portion of the printer assembly taken along 10—10 of FIG. 9.

Before cards are conveyed to the appropriate external station they may be printed if desired by actuation of apparatus 22. Referring now to FIGS. 2, 9 and 10, the printing apparatus preferably comprises a conventional pneumatic cylinder 31, and a permanently inked printing block 190 having conventional printing indicia or characters 191 rising from the card engaging side thereof. Cylinder 31 is preferably rigidly coupled to a stationary mounting bracket 193 which is rigidly attached to an adjustable positioning bracket 195 via an L-bracket 196 and a mounting bolt 197. Piston rod 200 extends through bracket 193 and is threadably received within a push plate 202, being anchored thereto by bolt 203. An upper slide rod 204 extends through an aperture in mounting bracket 193 and is similarly threadably received within push plate 202 and anchored thereto by a bolt 205. As best illustrated in FIG. 2, mounting bracket 193, and thus cylinder 31, can be varied in position by adjustment of nuts 207 and 208 which determine the position of a mounting bracket 210 relative to plate 195. Bolt 208 extends through a tab portion of a rearwardly extending rod 212 and is received within a similar tab portion in rod 214 which is journaled within an orifice provided in offset positioning bracket 195.

The printing block 190 (FIGS. 9 and 10) is preferably removeably attached to push plate 202 by a pair of side mounting brackets 216 and 217 and an upper bracket 218 which engages the top of push plate 202 to prevent printing block 190 from dropping. A plurality of adjustable screws 220A through 220D are provided to prevent printing indicia 191 from being squashed when contacting the tag or card to be printed. An internal key 201 received within slot 201*a* in plate 202 aligns plate 190 with respect to plate 202. Screws 220A through 220B are threadably received through plate 190 and secured in position by a plurality of corresponding bolts 221A through 221D. Thus the shank tip portion of each of the screws 220A through 220B will contact the card to prevent smudging or smearing of the printing indicia 191 from overcompression thereof against the card. As best illustrated in FIG. 2, during the printing operation cards or tags to be printed will be sandwiched between the deflected printing plate 190 and the stationary printing back plate 188, which will prevent rearward movement of the cards during the printing operation. Plate 188 is secured to plate 38 via a pair of angle brackets 189 and 189A.

Figure 11:
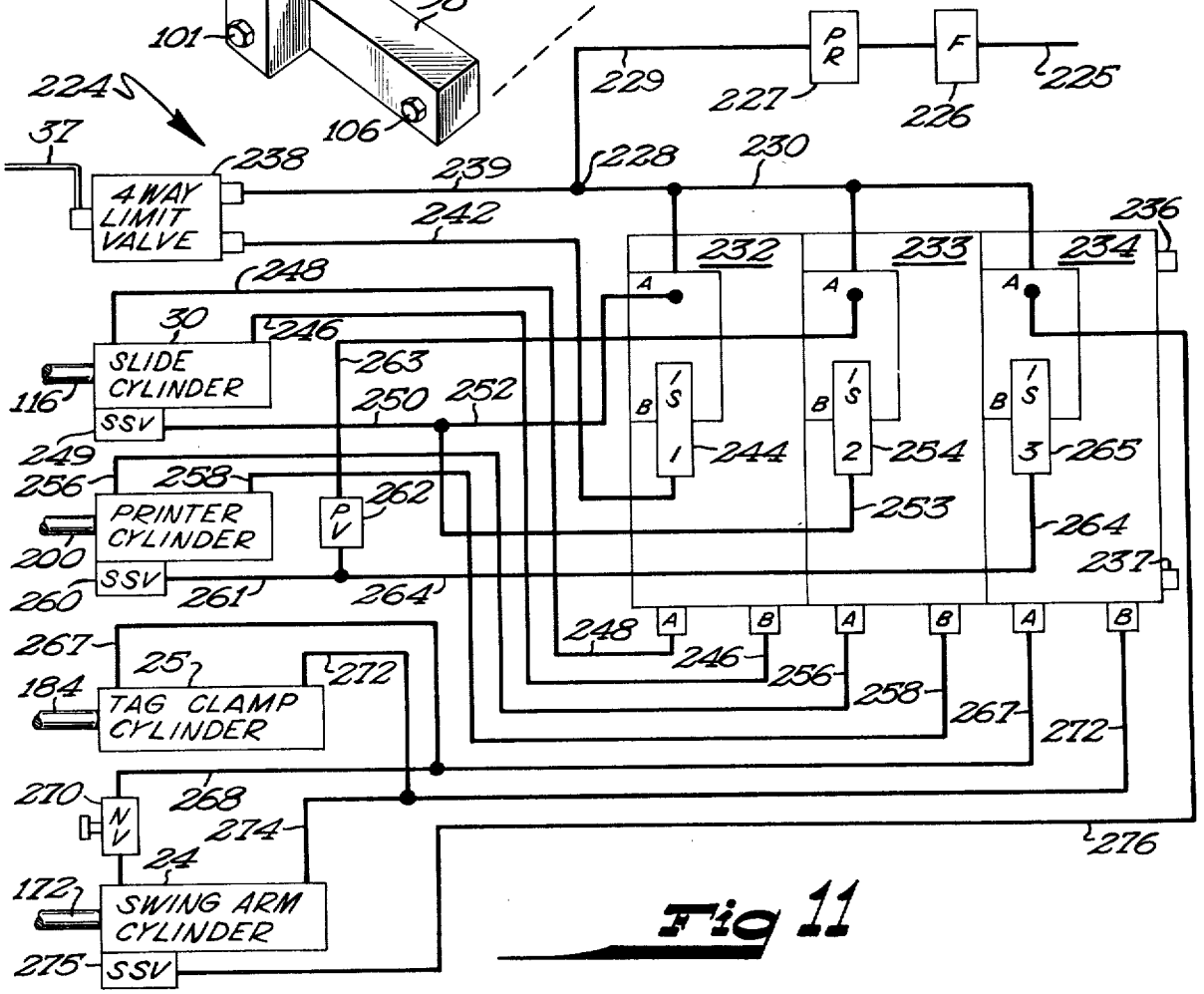
FIG. 11 schematically depicts the pneumatic actuation apparatus preferably employed with the instant invention.

The pneumatic apparatus 224 (FIG. 11) provides coordinated actuation of each of the pneumatic cylinders discussed previously. As mentioned earlier, apparatus 224 is preferably housed within enclosure 32 at the rear of the apparatus 10. While a pneumatic system is disclosed it will be understood by those skilled in the art that alternative systems employing electromechanical transducers or hydraulic apparatus, for example, would be of equal utility.

The apparatus 224 is adapted to be connected to a conventional pneumatic pressure source on an input hose 225, which leads to a conventional filter 226 and through a conventional pressure regulator 227 to a T-manifold 228 via hose 229. An input line 230 connects to each of the plurality of conventional relay valves 232 through 234. The relay valves 232 through 234 share common air exhaust vents 236 and 237. A second output from T manifold 228 is delivered to a conventional four way limit valve 238 via a line 239. Valve 238, for example, is available from Numatics Inc., Highland, Mich., Model LR3-0201. Valves 232 through 234 are preferably Numatics type PA7, model 11DPA4110.

Mechanical operation of the apparatus 10 is initiated when a bag or other item to be labeled with the tags 12 passes by on a conveyor route and actuates a mechanical finger 37 to initiate actuation of apparatus 10 by triggering limit valve 238. Valve 238 and finger 37 are adapted to be remotely located in a desired trigger position. Valve 238 outputs a pressure pulse on a line 242 thereby actuating relay valve 232 on an input terminal 244 thereof. When relay valve 232 is thus actuated, a pneumatic output therefrom appearing on a line 246 is delivered to slide cylinder 30 for actuation of the card ejecting push plate 20. Another output line 248 extending between relay valve 232 and slide cylinder 30 normally maintains cylinder 30 in the retracted or inoperative position. When slide cylinder 30 reaches maximum displacement thereby outputting a card or tag from the discharge apparatus, a return pressure pulse derived from a stroke signal valve 249 provides a pulse on a line 250 which resets relay valve 232 on a line 252 and triggers relay valve 233 via a line 253 connected to relay input 254. Cylinder 30 (including the associated stroke signal valve) is available from Mosier Industries, Inc., Brookville, Ohio, denominated Model ETF.

Relay valve 233 normally maintains the printer cylinder 31 in a retracted position via a line 256 which is connected to the forward end of the cylinder 31 in the conventional manner. When a pulse appears on line 253, however, an output from relay valve 233 appearing on output line 258 actuates the printer cylinder to initiate the previously discussed printing function. When the printing function is completed a trigger pulse outputted by a stroke signal valve 260 appears on a line 261, thereby resetting relay valve 233 via a vent valve 262 and a reset line 263 connected to a reset input of relay valve 233. The pulse outputted from stroke signal valve 260 also triggers relay valve 234 on line 264 which is fastened to an input 265. When the printing operation is not desired, valve 233 and cylinder 31 can of course be omitted. Cylinder 231 is preferably a Mosier Model ETFR.

Output pressure from relay valve 234 on line 267 maintains the tag clamping cylinder 25 and the swing arm cylinder 24 in a normally retracted position. Cylinders 24 and 25 are also available from Mosier, designated Model ETF. Pressure on line 267 reaches the forward end of swing arm cylinder 24 through a line 268 and a needle valve 270, which may be adjusted to control the speed of the spring arm rate. A line 272 delivers a pneumatic pulse output from relay valve 234 to the tag clamp cylinder 25 so that the tag gripping apparatus 28 will be actuated, and simultaneously the swing arm cylinder 24 will be actuated via a line 274 to convey tags or groups of cards grasped by apparatus 28 to a predetermined external position by deflecting swing arm apparatus 16. When piston 172 is fully deflected from the swing arm cylinder 24, a reset signal derived from stroke signal valve 275 will be transmitted on a return line 276 to thereby reset relay valve 234. When another bag or package to be labeled by tags 12 passes by a conveyor route and again actuates finger sensor 37 (on limit valve 238) the process will be repeated in the manner previously described, and the cycle may repeat indefinitely.

OPERATION

The apparatus 10 is thus adapted to be employed in conjunction with an automated bag or package conveyor system where the bags or packages are to be labeled or provided with the cards or tags 12. Actuation finger 37 must first be positioned so that it will contact items being conveyed to actuate apparatus 10. Of course pneumatic hose 225 must be connected to an appropriate conventional air source as previously mentioned.

The cards or tags (or groups or tags or cards) to be fastened (by external apparatus, not shown) to the items to be labeled are first placed within the magazine 14 by retracting pressure plate 46 and manually inserting the cards within the card receptive space provided. Of course, as mentioned earlier, the card engaging knife 64 on pusher plate 20 must be adjusted to engage the desired quantity or number of cards to be outputted each cycle, and the spacing of tag discharge gate 126 must be set up as mentioned in conjunction with the discussion of FIG. 8. Additionally, where it is desired to print information on the cards or tags before being attached to the product, the printer block 190 can be set up as desired by selection of the printing indicia 191. Usually only one card or tag at a time will be outputted from tag discharge apparatus 12.

Cards or tags will be slidably outputted by pusher plate 20 and will be retained by spring clamp 186 at the mouth of the feed gauge dispensing means 18 until they may be printed as desired. Immediately afterwards the tag gripper jaws on swing arm 166 will grasp the card or tag (or groups of tags or cards), and arm 166 will be conveyed outwardly (as shown in FIG. 3) by cylinder 24. While it is contemplated that the cards or tags will be delivered to an external bag sewing station for attachment to bags of seeds or grain, the apparatus 10 is of course ideally adapted for use in a variety of other product labeling or conveying systems. As will be recognized by those skilled in the art, where the mouth of feed gate dispensing means 18 can be positioned immediately adjacent a card input end of another machine or apparatus, the swing arm cylinder and the swing arm assembly may be omitted. Since cards are forcibly engaged by the push plate, the apparatus is substantially unaffected by dust or other airborne particles.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Apparatus for outputting tags or the like, said apparatus comprising:

magazine means for storing a predetermined quantity of said tags;

feed gate dispensing means for automatically and periodically moving a predetermined number of tags out of said magazine means, said dispensing means comprising:

rigid means adjacent said magazine means for defining an elongated channel portion; and reciprocally movable push plate means slidably received within said elongated channel portion, said push plate means adapted to selectively contact said predetermined number of tags for moving same out of said dispensing means;

swinging arm means for selectively moving said predetermined number of tags outputted by said dispensing means to a predetermined remote position, said swinging arm means comprising:

pivotal arm means swingable from a tag receptive position adjacent said dispensing means to said remote position, said arm means comprising a gripping arm head, a gripping clamp, and actuation means for selectively urging said gripping clamp into compressive abutment with said arm head thereby securing said predetermined number of tags outputted by said push plate means therebetween; and means for selectively swinging said arm means from said tag receptive position to said remote position.

2. The combination as defined in claim 1 wherein said elongated channel portion is defined between spaced apart, upper and lower planar plates adjacent said magazine means, and said dispensing means comprises tag retaining gate means in spaced apart parallel relationship with said upper and lower plates for defining at least one tag passage slot between said gate means and said planar plates.

3. The combination as defined in claim 3 wherein said apparatus comprises slide bar suspension means for slidably mounting said push plate means for reciprocal movement within said elongated channel in aligned relationship with respect to said upper and lower planar plates.

4. The combination as defined in claim 3 wherein said push plate means comprises tag engaging knife means for pushing said tags through said tag passage slot.

5. The combination as defined in claim 1 wherein said apparatus comprises tag retaining gate means defining an upper tag passage slot portion, a lower tag passage slot portion, and a central tag passage slot portion, said central tag passage slot portion having a width substantially equal to the thickness of said predetermined number of tags to be moved, and said upper and lower tag passage slots having a width substantially greater than the width of predetermined number of tags to be moved, thereby preventing jamming of said dispensing means due to irregularities in said tags.

6. The combination as defined in claim 1 wherein said apparatus comprises:

first sensing means for actuating said apparatus in response to movement of a conveyed object past a predetermined position; and second sensing means for resetting said apparatus in response to movement of said pivotal arm means to said external position, thereby returning said pivotal arm means to said tag receptive position.

7. The combination as defined in claim 6 wherein said apparatus comprises:

first cylinder means for actuating said push plate means;

first relay valve means for actuating said first cylinder means;

initiation valve means responsive to movement of a conveyed item to be labeled for actuating said first relay valve means;

second cylinder means for actuating said swing arm means;

second relay valve means for actuating said second cylinder means; and first signal stroke valve means for actuating said second relay valve means in response to displacement of said first cylinder means.

8. The combination as defined in claim 1 wherein said apparatus comprises:

movable printing block means adjacent said feed gate dispensing means for engaging and printing information on said tags; and power means operable to move said printing block means to a tag engaging position.

9. Tag feeding apparatus comprising:

magazine means for storing a predetermined quantity of said tags;

feed gate dispensing means for automatically and periodically moving a predetermined number of tags out of said magazine means, said dispensing means comprising:

rigid means adjacent said magazine means for defining an elongated channel portion; and reciprocally movable push plate means slidably received within said elongated channel portion, said push plate means adapted to selectively contact said predetermined number of tags for moving same out of said dispensing means;

swinging arm means for selectively moving said predetermined number of tags outputted by said dispensing means to a predetermined remote position;

first cylinder means for actuating said push plate means;

first relay valve means for actuating said first cylinder means;

initiation valve means responsive to movement of a conveyed item to be labeled for actuating said first relay valve means;

second cylinder means for actuating said swing arm means;

second relay valve means for actuating said second cylinder means; and first signal stroke valve means for actuating said second relay valve means in response to displacement of said first cylinder means.

10. The combination as defined in claim 9 wherein said apparatus comprises tag retaining gate means for defining an upper tag passage slot portion, a lower tag passage slot portion, and a central tag passage slot portion, said central tag passage slot portion having a width substantially equal to the thickness of said predetermined number of tags to be moved, and said upper and lower tag passage slots having a width substantially greater than the width of said central tag passage slot, thereby preventing jamming of said dispensing means due to irregularities in said tags.

11. Apparatus for outputting tags or the like, said apparatus comprising:

magazine means for storing a predetermined quantity of of said tags;

feed gate dispensing means for automatically and periodically moving a predetermined number of tags out of said magazine means, said dispensing means comprising:

rigid means adjacent said magazine means for defining an elongated channel portion; and reciprocally movable push plate means slidably received within said elongated channel portion, said push plate means adapted to selectively contact said predetermined number of tags and move same out of said dispensing means to a pickup position;

a pivotal arm swingable from a tag receptive position adjacent the output side of said feed gate to a predetermined remote position, said arm having tag gripping means mounted thereon, whereby said arm may grip tags at said tag pickup position and deliver them to said remote position;

means for printing information on said tags, said printing means comprising:

movable printing block means adjacent to the output side of said feed gate for selectively engaging said tags at said tag pickup position thereby printing information on said tags; and means for actuating said printing block means in response to movement of said push plate means to said tag pickup position.

12. The combination as defined in claim 11 wherein said apparatus comprises:

power means for selectively swinging said pivotal arm from said tag receptive position to said remote position; and control means operative to actuate said power means to swing said pivotal arm between said tag receptive position and said remote position in response to the movement of said printing block into engagement with a tag.

13. Apparatus for outputting tags or the like, said apparatus comprising:

magazine means for storing a predetermined quantity of said tags;

feed gate dispensing means for automatically and periodically moving a predetermined number of tags out of said magazine means, said dispensing means comprising:

rigid means adjacent said magazine means for defining an elongated channel portion; and reciprocally movable push plate means slidably received within said elongated channel portion, said push plate means adapted to selectively contact said predetermined number of tags for moving same out of said dispensing means;

means for printing information on said tags, said printing means comprising movable printing block means for engaging and printing information on said tags and means for actuating said printing block means;

swinging arm means for selectively moving said predetermined number of tags outputted by dispensing means to said external position;

first cylinder means for actuating said push plate means;

first relay valve means for actuating said first cylinder means;

initiation valve means responsive to movement for actuating said first relay valve means;

second relay valve means for actuating said printing block cylinder means;

first signal stroke valve means for actuating said second relay valve means in response to displacement of said first cylinder means;

third cylinder means for actuating said swing arm means;

third relay valve means for actuating said third cylinder means;

second signal stroke valve means for actuating said third relay valve means in response to displacement of said printing block actuation means; and third signal stroke valve means for resetting said third relay valve means in response to displacement of said third cylinder means.

14. A machine for processing tags, cards or the like, said machine comprising:

magazine means for storing a predetermined quantity of said tags;

slidably displaceable push plate means for moving a predetermined number of said tags out of said magazine means to a preselected position;

means for printing information on tags displaced by said push plate means;

means for moving tags from said preselected position to a remote external position;

first cylinder means for actuating said push plate means;

second cylinder means for actuating said printing means;

third cylinder means for actuating said moving means;

first relay means for actuating said first cylinder means;

initiation valve means responsive to movement for actuating said first relay valve means;

second relay valve means for actuating said second cylinder means;

first signal stroke valve means for actuating said second relay valve means and for resetting said first relay valve means in response to displacement of said first cylinder means;

third relay valve means for actuating said third cylinder means;

second signal stroke valve means for actuating said third relay valve means and for resetting said second relay valve means in response to displacement of said second cylinder means; and third signal stroke valve means for resetting said third relay valve means in response to displacement of said third cylinder means.

15. Apparatus for outputting tags or the like comprising:

magazine means for storing a predetermined quantity of tags;

feed gate dispensing means for automatically and periodically moving a predetermined number of tags out of said magazine means, said dispensing means comprising:

reciprocally movable push plate means slidably received within elongated channel means and adapted to selectively contact said predetermined number of tags; and first power means operable to move said push plate means to selectively contact said predetermined number of tags and move same out of said dispensing means to a tag pickup position;

a pivotal arm swingable from a tag receptive position adjacent said dispensing means to a predetermined remote position, said pivotal arm having tag gripping means mounted thereon, comprising first and second clamping members movable relative to each other for clamping a tag therebetween whereby said pivotal arm may grip said predetermined number of tags outputted by said dispensing means and deliver same to said predetermined, remote position;

second power means for selectively swinging said pivotal arm between said tag receptive position and said remote position;

first sensing means for actuating said apparatus in response to movement of a conveyed object past a predetermined position; and control means operative to actuate said second power means for delivering a tag by movement of said pivotal arm to said remote position in response to movement of said push plate to said tag pickup position.

16. The combination as defined in claim 15 wherein said apparatus comprises:

second sensing means operative to actuate said second power means to return said pivotal arm to said tag receptive position in response to movement of said pivotal arm to said remote position.

* * * * *